US005823335A

United States Patent [19]

Joh

[11] Patent Number: 5,823,335

[45] Date of Patent: Oct. 20, 1998

[54] GOLF CLUB DIVIDER ASSEMBLY

[76] Inventor: William K. Joh, 6852 Vachon Dr., Bloomfield Hills, Mich. 48301

[21] Appl. No.: 694,989

[22] Filed: Aug. 9, 1996

Related U.S. Application Data

[63] Continuation-in-part of Ser. No. 585,400, Jan. 11, 1996, Pat. No. 5,613,603, which is a continuation-in-part of Ser. No. 410,913, Mar. 27, 1995, Pat. No. 5,505,300.

[51] Int. Cl.[6] ..... A63B 55/00

[52] U.S. Cl. ..... 206/315.6; 206/315.4

[58] Field of Search ..... 206/315.3–315.7; 211/70.2

[56] References Cited

U.S. PATENT DOCUMENTS

| | | | |
|---|---|---|---|
| 2,396,021 | 3/1946 | Schloss | 150/160 |
| 2,747,636 | 5/1956 | Couture | 150/160 |
| 3,053,298 | 9/1962 | Stamp | 206/315.6 X |
| 3,253,627 | 5/1966 | Koetting | 150/160 |
| 3,521,689 | 7/1970 | Woods, Jr. | 150/159 X |
| 4,311,178 | 1/1982 | Kennedy | 206/315.6 |
| 4,753,344 | 6/1988 | Antonious | 206/315.3 |
| 4,932,523 | 6/1990 | Yamazoe | 206/315.6 |
| 4,955,472 | 9/1990 | Yamazoe | 206/315.6 |
| 5,103,974 | 4/1992 | Antonious | 206/315.6 |
| 5,279,414 | 1/1994 | Brasher | 206/315.6 |
| 5,447,228 | 9/1995 | Hodgson, III | 206/315.3 |
| 5,465,839 | 11/1995 | Gretz | 206/315.6 |
| 5,465,840 | 11/1995 | Joh | 206/315.6 |
| 5,505,300 | 4/1996 | Joh | 206/315.6 |

FOREIGN PATENT DOCUMENTS

| | | | |
|---|---|---|---|
| 719092 | 2/1932 | France | 206/315.3 |
| 705115 | 3/1954 | United Kingdom | 206/315.5 |
| 864624 | 4/1961 | United Kingdom | 206/315.5 |
| 2130102 | 5/1984 | United Kingdom | 206/315.6 |

*Primary Examiner*—Sue A. Weaver
*Attorney, Agent, or Firm*—Gifford, Krass, Groh, Sprinkle, Patmore, Anderson & Citkowski, P.C.

[57] ABSTRACT

An improved golf club divider assembly retains a plurality of golf clubs in an orderly and secured fashion. An outer bag frame has a desired height and a rectangular shape when viewed in cross section. The interior of the bag is hollow and receives in an axially inserted fashion a primary club divider member. The primary divider member is constructed of a plurality of axially directed and radially outwardly extending vane portions which, upon insertion of the divider member, subdivides the hollow interior into a first group of axially extending compartments. A plurality of secondary club divider members are constructed in a similar fashion as to the primary divider member and are sized so that, upon insertion, the first group of compartments are subdivided into a second plurality of axially extending compartments capable of each receiving a club shaft of a golf club. The secondary club divider members are further sized according to differing heights so that they accommodate the differing shaft lengths of the golf clubs.

11 Claims, 2 Drawing Sheets

GOLF CLUB DIVIDER ASSEMBLY

CROSS REFERENCE TO RELATED APPLICATION

The present application is a continuation-in-part of application Ser. No. 08/585,400, filed Jan. 11, 1996, now U.S. Pat. No. 5,613,603, which is a continuation-in-part of application Ser. No. 08/410,913, filed Mar. 27, 1995, now U.S. Pat. No. 5,505,300.

BACKGROUND OF THE INVENTION

1. Field of the Invention

The present invention relates generally to golf club divider inserts and assemblies and, more particularly, to an improved golf club divider assembly for utilizing substantially the entire available space within a bag enclosure.

2. Description of the Prior Art

A number of different assemblies are known in the art for subdividing the interior space within a golf bag for receiving a plurality of golf clubs. The objective of each such assembly is to efficiently locate the plurality of clubs in a manner which allows easy access for the user.

U.S. Pat. No. 4,311,178, issued to Kennedy, teaches an interior space divider for a golf bag which includes an outer flexible sheath defined by a single sheet which is wrapped around an interlocking plurality of rigid and planar divider panels formed as one piece. Locater slots are formed in the sheath which engage tabs positioned around the one-piece divider panel structure to properly locate the sheath.

The disadvantage of the bag structure of Kennedy is that it still does not provide an individual sheathing protection to each club, rather it defines only a limited number of subdivided spaces which requires that a plurality of clubs be located in each. Furthermore, the one-piece divider panel structure and overlaying sheath do not appear to provide a very durable bag structure or adequate storage for necessary golf items such as balls, tees and the like.

U.K. Patent Applicaton 2 130 102 discloses a golf bag divider constructed of a plurality of stackable members which, when assembled one on top of another, define a plurality of axially extending compartments. Locating pins are utilized to align the members and a metal rod is inserted through a central aperture to assemble the unit. As is illustrated in FIG. 4, an outer bag can be applied around the structure.

While providing an effective means of creating a plurality of individually sub-divided compartments for a golf bag, the shortcoming of U.K. '102 is the time and energy necessary to assemble the structure. An additional shortcoming is the inability to provide a plurality of enclosures according to differing axially extending lengths to account for the differing lengths of the golf clubs.

U.S. Pat. No. 5,279,414, issued to Brasher, teaches a golf club bag with club compartments for storing the golf clubs in a club heads down position. A central hollow core element is provided for the longer wood clubs and an outer iron club area is defined by a plurality of spaced-apart wall partitions which are arranged in an angled fashion when viewed in cross section.

The outer iron receiving areas of Brasher are illustrated as being shorter in axial length than the central wood receiving area, however the complex nature of the angled partition walls, coupled with the necessity of drawing the club from a heads down position, tends to make the design fairly unwieldy in use.

SUMMARY OF THE PRESENT INVENTION

The present invention is an improved golf club divider assembly for retaining a plurality of golf clubs in an orderly, secure and segregated fashion. A skeletal outer frame has a predetermined height and is of a generally polygonal, preferably rectangular, shape in cross section. The outer frame is defined by a hollow interior and is supported upon a pedestal base which defines a closed bottom. A skin covering is typically applied over the skeletal outer frame to create the overall bag enclosure.

A primary club divider member is constructed of a plurality of axially directed vane portions which extend radially outwardly at desired angular intervals when viewed in cross section. The primary divider member is axially inserted within the hollow interior of the outer support structure to subdivide the interior into first, second, third and fourth axially extending compartments.

A plurality of secondary club divider members, and preferably first, second, third and fourth secondary divider members, are provided and are separately inserted into each of the compartments formed by the primary divider member to further subdivide the compartments into first, second, third and fourth subdivided and club shaft receiving compartments. The four secondary club divider members are further provided with differing overall lengths to accommodate the corresponding varying lengths of the golf clubs.

Accordingly, the provision of the primary club divider member and four secondary club divider members results in the creation of sixteen individual and axially extending club receiving cavities according to varying lengths. The individual subdivided cavities according to the teachings of this invention accommodate an entire set of regulation golf clubs and also can hold additional clubs, ball retriever devices and the like.

The primary and secondary club dividers also provide covering means for individually protecting the upwardly extending heads of the golf clubs in the form of covering members which extend between successive vanes and are detachably secured to surround a given club head. Larger covering members for protecting the heads of the woods and drivers can also include zippers extending their length which permit opening of the covering member without the necessity of detaching it from the vanes. A bag covering skin can further be applied over the skeletal outer support structure surrounding the divider member to give the divider assembly a conventional appearance.

BRIEF DESCRIPTION OF THE DRAWING

Reference will now be had to the attached drawing, when read in combination with the following specification, wherein like reference numerals refer to like parts throughout the several views, and in which.

DETAILED DESCRIPTION OF THE PREFERRED EMBODIMENT

Figure 1:
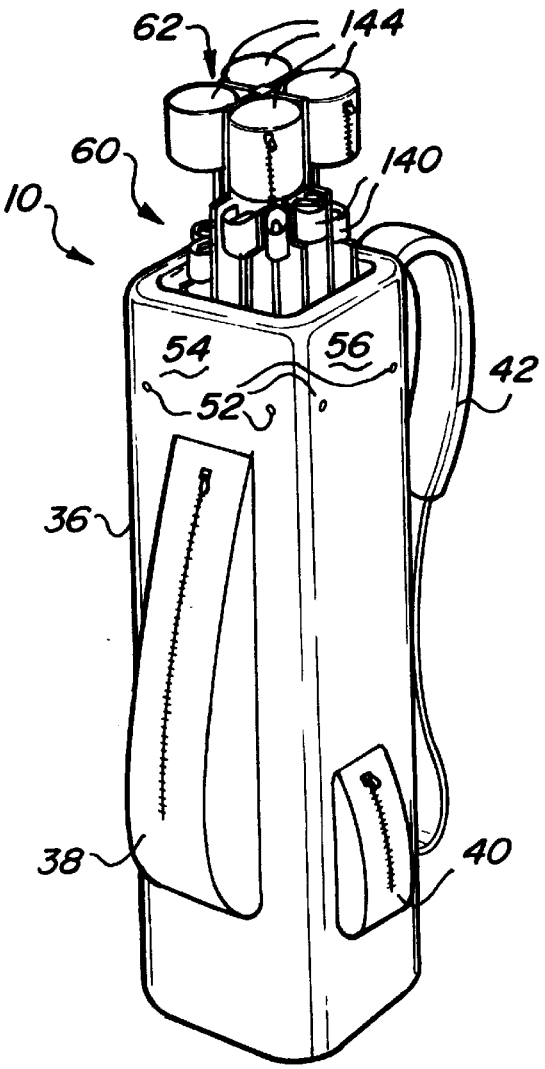
FIG. 1 is a perspective view of a golf club divider assembly according to the present invention.

Referring to FIGS. 1–4, an improved golf club divider assembly 10 is shown for retaining a plurality of golf clubs in an orderly and secure fashion according to the present invention. A skeletal outer frame structure 12 is provided and includes four upwardly extending support members 14, 16, 18 and 20 which are illustrated in cross section in FIG. 3 and which are shown in perspective in FIGS. 2 and 4 with the exception of support member 16 which is hidden from view.

Referring again to FIG. 2, pluralities of upper, intermediate and lower bracing cross members, identified at 22, 24 and 26, respectively, extend between the upwardly extending support members 14, 16, 18 and 20 to create the skeletal frame structure 12 and provide it with a degree of durability. The bracing cross members 22, 24 and 26 can be secured to the upwardly extending support members in any conventional fashion such as by nails or adhesives.

In an alternative arrangement, the skeletal outer frame 12 with upwardly extending support members and cross members can be formed in an integral one-piece manner out of a lightweight and durable metal or a polymer composition exhibiting the necessary properties of impact resistance and resiliency. A pedestal base support 28, illustrated in FIG. 2 as being of a circular shape but also capable of being polygonally shaped, is secured to corresponding bottom portions of the upwardly extending support members. Specifically, connection 30 is established between the bottom portion of the support member 14 and the pedestal support 28, and likewise connections 32 and 34 are established between corresponding portions of upwardly extending supports 18 and 20 and the pedestal support 28. Again, upwardly extending support 16 is hidden from the view of FIG. 2 but it is understood that a like connection is employed.

Referring again to FIG. 1, an exterior skin covering 36 is applied over the upwardly extending supports of the skeletal outer frame 12 and is preferably constructed of a durable leather or cloth-type material. The skin covering 36 typically includes one or more pouch enclosures 38 and 40 for such accessories as golf balls, tees and the like as well as a carrying strap 42. The skin covering is preferably of a one-piece construction and the carrying strap is mounted directly to the frame to prevent ripping of the skin during use.

Figure 1A:
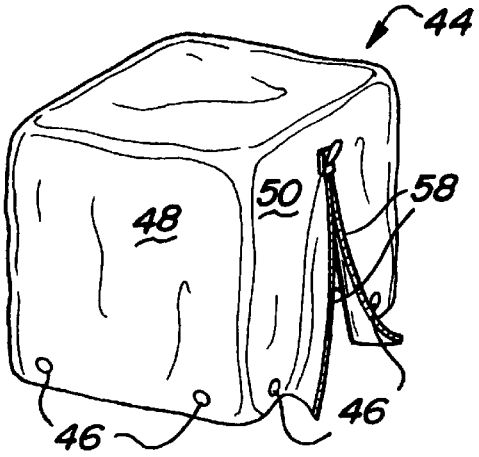
FIG. 1*a* is a partial view of a zippered top cover for attaching over the bag divider structure according to the present invention.

Referring further to FIG. 1*a*, a releasably attachable zippered hood 44 is provided for selectively applying over the corresponding top of the golf bag. The attachable hood 44 includes a first plurality of snap fasteners 46 arranged along sides, illustrated at 48 and 50, which cooperatively engage with corresponding snap fasteners 52 arranged along sides 54 and 56 of the golf bag skin covering 36 to secure the hood over the open top of the golf bag.

A zippered portion 58 is formed along one side of the hood 44, side 50, and may be selectively opened to drape the hood 44 over the side of the bag and to reveal the upwardly extending golf clubs without the necessity of detaching the hooded portion 44 from the bag. It is further understood that snap fasteners 46 and 52 may be employed along all four sides of rectangular bag structure shown in the drawings.

Referring again to FIGS. 1–4, a club dividing assembly 60 is illustrated for subdividing an open interior defined by the skeletal outer frame 12. A primary club divider member 62 includes a central upwardly extending portion 64 and a plurality of, and preferably first 66, second 68, third 70 and fourth 72, axially directed and radially outwardly extending vane portions. The axially extending vane portions 66, 68, 70 and 72 are preferably angularly separated by 90° increments so that they extend in a substantially perpendicular and grid-shaped pattern.

Figure 2:
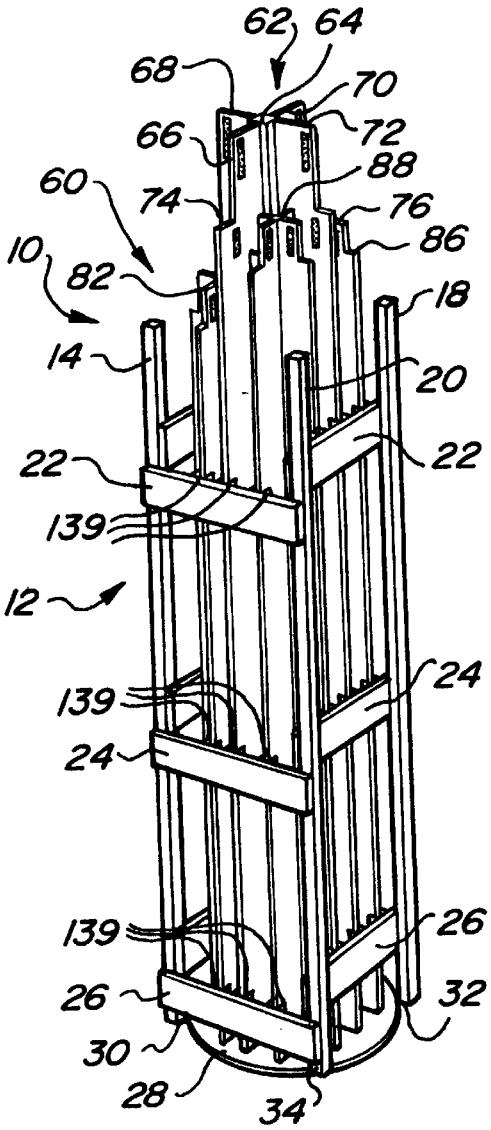
FIG. 2 is a view similar to that shown in FIG. 1 and further illustrating the primary club divider member and secondary club divider members assembled within the outer frame.
Figure 3:
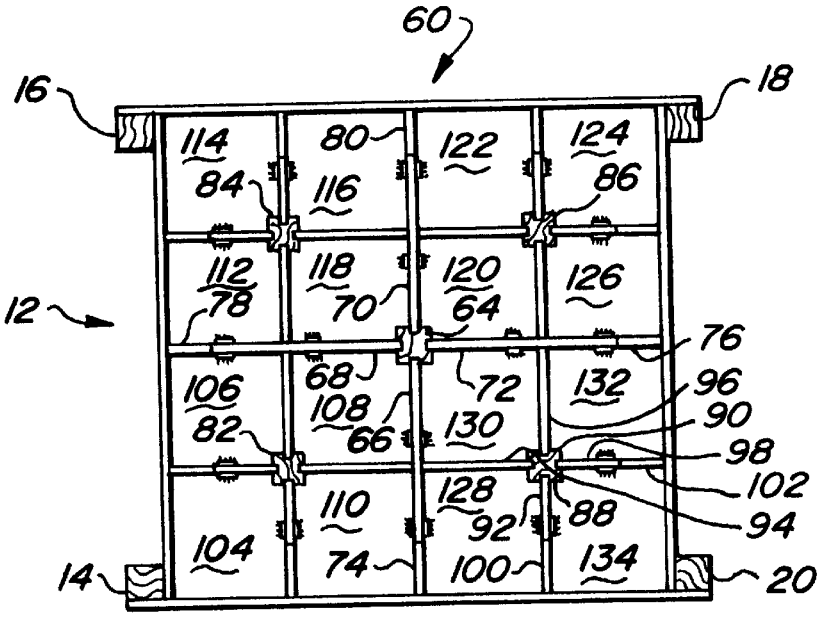
FIG. 3 is a top view of the primary and secondary club divider members and outer support structure as illustrated in FIG. 2.
Figure 4:
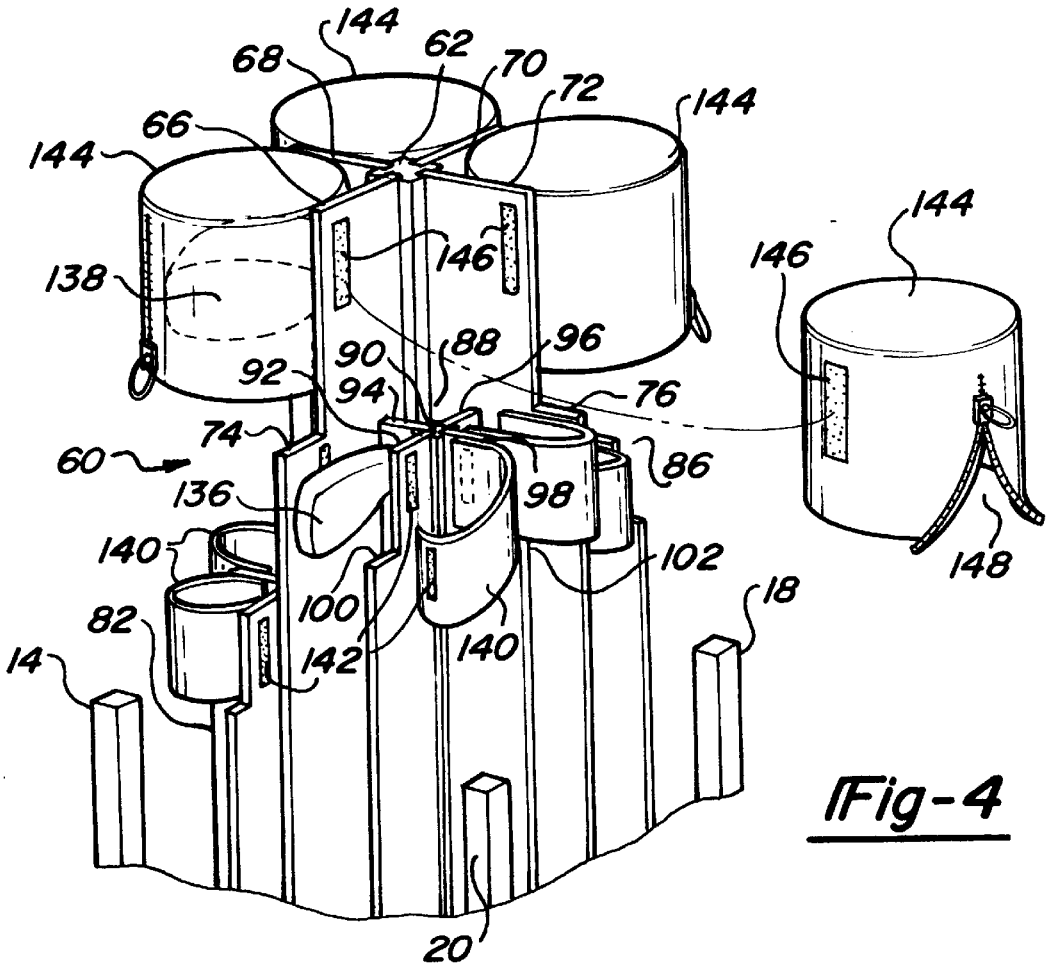
FIG. 4 is a perspective view of the upper portions of the club divider members and illustrating the covering members for protecting the golf club heads.

The four radially extending vane portions of the primary divider member 62 are further outwardly stepped, as illustrated by an intermediate and horizontally extending surface 74 for vane 66 and horizontally extending surface 76 for vane 72 in FIGS. 2 and 4, to separate the axially directed vane portions each into an upper inwardly stepped portion and a lower outwardly stepped portion. As can further be seen upon reference to the top cross section in FIG. 3 when viewed in combination with the perspective views of FIGS. 1, 2 and 4, the vane portion 68 is outwardly stepped along horizontally extending surface 78 and the vane portion 70 is likewise stepped along surface 80.

Upon axial insertion of the primary club divider member 62 into the outer frame 12, the outwardly stepped surfaces of the vane portions contact corresponding interior surfaces of the bag outer frame 12 so that the hollow interior is subdivided into a first plurality of first, second third and fourth quadrants (see especially FIG. 3). A plurality of secondary club divider members, and preferably first 82, second 84, third 86 and fourth 88 divider members are likewise provided and are each constructed of a central upwardly extending portion and four axially directed and radially outwardly extending vane portions.

To facilitate ease of explanation, reference is made to the fourth divider member 88 which is the most clearly illustrated in the drawing figures. As is best shown in FIGS. 2 and 4, the secondary divider member 88 includes central upwardly extending portion 90 and outwardly extending vane portions 92, 94, 96 and 98. Each of the vane portions are further outwardly stepped in the same fashion as that described for the primary club divider member 62.

Specifically, an intermediate horizontally extending surface 100 defines the outward step for the vane portion 92 which separates the vane into an inwardly stepped upper portion and an outwardly stepped lower portion and a likewise intermediate horizontally extending surface 102 defines the outward step for the vane portion 98 which likewise separates the vane into an inwardly stepped upper portion and an outwardly stepped lower portion. For clarity of illustration, the remaining upper and lower stepped vane portions of the first, second and third secondary divider members 82, 84 and 86 are shown but not enumerated, however it is understood that they are all constructed in an identical fashion when compared to the fourth divider member 88.

Referring again to the top cross section of FIG. 3, the four secondary divider members are sized so that they may be axially inserted into each of the four subdivided quadrants of the primary club divider member 62 to further subdivide the hollow and open interior of the outer frame 12 into a second plurality of individual club shaft receiving cavities. Specifically, the first secondary divider member 82 is inserted so that vertical edges of the outwardly stepped vane portions contact both the inner edges of the frame 12 and corresponding faces of the vanes 66 and 68 and subdivides the given quadrant into individual axially extending compartments, or shaft receiving cavities 104, 106, 108 and 110 (see again FIG. 3). Consistent with this description, the second secondary divider member 84 subdivides its associated quadrant into receiving cavities 112, 114, 116 and 118, the third secondary divider member 86 subdivides its associated quadrant into receiving cavities 120, 122, 124 and 126, and the fourth secondary divider member its associated quadrant into receiving cavities 128, 130, 132 and 134.

In all, sixteen individual and axially extending club shaft receiving cavities are created by the four secondary divider members 82, 84, 86 and 88 in combination with the primary divider member 62 for holding a set of golf clubs. As is best shown in FIG. 4, a golf club iron 136 can be inserted in a shaft first manner into its associated axially directed passageway or cavity, in this case cavity 128, so that the club head is positionally isolated between vane 92 of the fourth secondary divider member 88 and outwardly stepped surface 74 of the vane 66 of the primary divider member 62. Likewise, a golf club driver 138 having a driver head is isolated within a central cavity, 108 as seen from FIG. 3.

As can be seen from the drawing figures, and most specifically FIGS. 2 and 4, the primary club divider member 62 has an overall height greater than any of the four secondary club divider members. Each of the secondary club dividers 82, 84, 86 and 88 is further provided at a differing height for the purpose of accommodating golf clubs according to differing shaft lengths. As is best seen from FIG. 4, secondary divider member 88 is the tallest of the four, followed next by secondary divider 86 and then divider 82. Divider member 84 is hidden in the perspective views of FIGS. 1, 2 and 4, but can be of a selected height either greater or shorter than the secondary dividers 82, 86 and 88 as is desired. Additionally, inwardly facing and spaced apart tabs 139 extend from the cross braces 22, 24 and 36 and receive therebetween the abutting and axially extending edges of the vanes of the primary and secondary divider members so as to prevent undesirable rotation of the divider member after they have been inserted into the outer frame.

Referring again to FIGS. 1 and 4, covering members are provided for protecting and shielding the exposed heads of the golf clubs 136 and 138. The covering members are preferably in the form of flexible rectangular sheets constructed of either a durable cloth, synthetic or leather. A first plurality of covering members 140 are provided for individually protecting the heads of the shorter iron clubs housed within the four secondary divider members surrounding the primary divider member. Releasably securable portions 142 are provided on the outer edge surfaces of the vane portions of the primary and secondary divider members as well as along corresponding edges of the covering members 140. The releasably securing portions 142 on the covering members are attached to the securing portions 142 on the succeeding vane portions as is illustrated for releasably securing the covering members 140 around the projecting golf club iron heads.

A larger second plurality of covering members 144, preferably four, are likewise releasably attached between the four central vane portions of the primary club divider member to surround and protect longer clubs such as the golf club driver 138. The covering members 144 are usually larger than the members 140 for isolating the club irons, however they are constructed of the same types of material and also include releasably securing portions 146 located both on the covering members and the succeeding vane portions 66, 68, 70 and 72 for releasably attaching the covering members 144 in place.

As an additional feature, zippered portions 148 are provided lengthwise along each of the covering members 144, see FIG. 4, and can be unzipped to open the associated covering member at a central location to allow the club driver to be withdrawn without the necessity of releasably detaching the covering member 144 by the releasably securing portions 146 at each end. The covering members 140 and 144, in addition to the pluralities of releasably securing means 142 and 146, provide an effective means for securing the golf club heads at whatever their elevational position is relative to the other clubs.

It is therefore evident that the present invention discloses an improved golf club divider assembly for securing and arranging a complete regulation set of golf clubs, as well as ball retrievers and related items such as additional clubs, in a correct elevational and secure manner according to the isolated and grid-shaped layout. Additional advantages and embodiments will become apparent to those skilled in the art to which it pertains without deviating from the scope of the appended claims. On such embodiment is the provision of the primary and secondary dividers as an integrally formed one-piece unit.

I claim:

1. An improved golf club divider assembly for retaining a plurality of golf clubs in an orderly, secure and segregated fashion, said divider assembly comprising:

an outer frame having a central axis and a predetermined height along said axis and being generally polygonally shaped in transverse cross section, said frame further defining a hollow lengthwise extending interior and a pedestal base support;

a primary club divider member constructed of an elongated and central upwardly extending portion and a plurality of individual vane portions which extend both axially along an extending distance of said upwardly extending portion and radially outwardly from said upwardly extending portion, said primary divider member being inserted lengthwise within said frame to subdivide said hollow interior into a first plurality of axially extending compartments;

a plurality of secondary club divider members which are each in turn constructed of a central upwardly extending portion and a plurality of individual vane portions which extend both axially along an extending distance of said upwardly extending portion and radially outwardly from said upwardly extending portion, said secondary club divider members being each lengthwise within selected one's of said first plurality of axially extending compartments to subdivide said first selected compartments into a second plurality of axially extending compartments; and said second plurality of axially extending compartments defining, in combination with said primary club divider member, a plurality of individual club receiving cavities arranged in an interlocking pattern.

2. The golf club divider assembly according to claim 1, said primary club dividing member further comprising first, second, third and fourth vane portions, said first plurality of compartments defining first, second, third and fourth subdivided and axially directed compartments.

3. The golf club divider assembly according to claim 2, said plurality of said secondary club dividing members further comprising first, second, third and fourth vane portions, said second plurality of compartments defining first, second, third and fourth subdivided and axially directed compartments.

4. The golf club divider assembly according to claim 3, said secondary club dividing members further comprising first, second, third and fourth secondary dividing members which are lengthwise insertable respectively into said first, second, third and fourth subdivided and axially directed first plurality of compartments.

5. The golf club divider assembly according to claim 4, said first secondary club dividing member being sized according to a first overall length, said second secondary club dividing member according to a second overall length, said third secondary club dividing member according to a third overall length, and said fourth secondary club dividing member according to a fourth overall length, said first, second, third and fourth secondary dividing members accommodating golf clubs according to differing shaft lengths.

6. The golf club divider assembly according to claim 1, said primary club divider member and said plurality of secondary club divider members further comprising upper and longitudinally extending vane portions and lower and outwardly stepped vane portions.

7. The golf club divider assembly according to claim 4, further comprising a first plurality of covering members and releasable securing means for securing to said primary club divider member for shielding a first set of golf club heads, a second plurality of covering member being releasably secured to said first second, third and fourth secondary divider members for shielding a second set of golf club heads.

8. The golf club divider assembly according to claim 7, said releasable securing means further comprising first pluralities of detachable portions positioned on said vane portions of said primary and secondary club dividers, second pluralities of detachable portions being positioned on opposing edges of said covering members and being releasably secured to said first pluralities of detachable portions.

9. The golf club divider assembly according to claim 1, said outer frame comprising a skeletal structure constructed of a first plurality of four upwardly extending support members which are reinforced by second pluralities of brace members extending cross wise between said support members.

10. The golf club divider assembly according to claim 9, further comprising a bag skin surrounding and being applied over said skeletal structure.

11. The golf club divider assembly according to claim 10, further comprising a releasably attachable and zippered hood cover and snap fastening means for attaching said hood cover to said bag skin over the upwardly extending golf club heads.

* * * * *